US007465702B2

(12) United States Patent
Reichlin et al.

(10) Patent No.: US 7,465,702 B2
(45) Date of Patent: Dec. 16, 2008

(54) FABRIC RINSING COMPOSITION

(75) Inventors: Daniel Reichlin, Bernex (CH); Claudie Drevet Bellouard, La Roche sur Foron (FR); Laurent Mercier, Princeton, NJ (US)

(73) Assignee: Firmenich SA, Geneva (CH)

( * ) Notice: Subject to any disclaimer, the term of this patent is extended or adjusted under 35 U.S.C. 154(b) by 0 days.

(21) Appl. No.: 11/387,134

(22) Filed: Mar. 21, 2006

(65) Prior Publication Data

US 2006/0172902 A1 Aug. 3, 2006

Related U.S. Application Data

(63) Continuation of application No. PCT/IB2004/003250, filed on Oct. 4, 2004.

(30) Foreign Application Priority Data

Oct. 10, 2003 (EP) ..... 03022775

(51) Int. Cl.
*C11D 1/72* (2006.01)

(52) U.S. Cl. ..... 510/527; 510/522

(58) Field of Classification Search ..... 510/522, 510/527

See application file for complete search history.

(56) References Cited

U.S. PATENT DOCUMENTS

| | | | | |
|---|---|---|---|---|
| 6,117,436 | A * | 9/2000 | Flemming et al. | 424/401 |
| 6,495,506 | B1 * | 12/2002 | Massaux et al. | 510/417 |
| 7,033,987 | B2 * | 4/2006 | Depoot et al. | 510/437 |
| 2002/0123448 | A1 * | 9/2002 | Dunn | 510/421 |
| 2002/0148994 | A1 | 10/2002 | McGee et al. | 252/8.91 |
| 2005/0192199 | A1 * | 9/2005 | Cartwright et al. | 510/420 |

FOREIGN PATENT DOCUMENTS

| | | | |
|---|---|---|---|
| DE | 197 51 151 | A | 5/1999 |
| EP | 0 536 444 | A1 | 4/1993 |
| EP | 0 779 070 | A1 | 6/1997 |
| EP | 0 813 862 | B1 | 12/1997 |
| WO | WO 99/43777 | | 9/1999 |

OTHER PUBLICATIONS

K. Shinoda et al., "Phase Properties of Emulsions: PIT and HLB", Yokohama National University, Emulsions, Microemulsions and Solubilization, pp. 337-367 (1979).

* cited by examiner

*Primary Examiner*—John R Hardee
(74) *Attorney, Agent, or Firm*—Winston & Strawn LLP

(57) ABSTRACT

A fabric rinsing composition, free of cationic softening compound, in the form of an oil-in-water emulsion prepared by a phase inversion temperature process. The product of the invention provides a good rinsing while efficiently depositing perfume onto the treated fabric.

16 Claims, No Drawings

FABRIC RINSING COMPOSITION

CROSS-REFERENCE TO RELATED APPLICATIONS

This application is a continuation of International application PCT/IB2004/003250 filed Oct. 4, 2004, the entire content of which is expressly incorporated herein by reference.

TECHNICAL FIELD

The present invention relates to the field of fabric post-washing treatments. More particularly, it concerns a novel fabric rinsing composition usable for the post washing treatment of a material, said composition being principally characterised by the fact that it consists of an oil-in-water emulsion prepared by a phase inversion temperature process. The composition of the invention, which is free of any cationic softening agent, comprises a high quantity of perfume and advantageously allows to reach an effective deposition of the latter onto the treated material. On the other hand, the aqueous phase of the emulsion comprises an organic or inorganic acid responsible for a perfect rinsing of the fabric which has previously been subjected to a conventional washing.

BACKGROUND

Fabric softener compositions are widely described in the prior art, and are in particular the object of many patent applications. These compositions constitute the main class of consumer products intended for a fabric treatment subsequent to the fabric washing, and they are primarily designed to achieve what is usually referred to as fabric "softness", which designates the quality of the treated fabric whereby its handling or texture is smooth, pliable and fluffy to the touch. Fabric softness also connotes the absence of static "cling" in the fabrics.

Various chemical compositions have long been known to possess the ability to soften fabrics when applied to them during the laundering operation, particularly during the rinse cycle. The most commonly used softening agents are cationic softeners which provide both softening and antistatic benefits when applied to fabrics. More particularly, softening effects provided by compositions for laundered garments are typically achieved by delivering a quaternary ammonium compound to the surface of the fabric. These cationic, water insoluble quaternary ammonium compounds include in particular esterquats, imidazolinium quats, di-fatty diamido ammonium methyl sulfate, di-fatty amidoamine and di-tallow dimethyl ammonium chloride. The well-known effectiveness of the conventional cationic fabric softeners is based in particular on the distinct chemisorption of the emulsified cationic particles, which are absorbed on the fibre by virtue of the ionic interaction with the anionic fibre surface. It is also known in the literature that good softening effects can be achieved by mixing non-ionic and cationic softeners.

In spite of the usefulness of cationic softeners to improve the fabric touch after washing thereof, it is advantageous to find alternatives to these compounds for use in fabric softeners, which may impart to the fabrics a less "fatty" touch, for example, whilst efficiently transporting fragrance into the textiles treated, such that the latter exhibit the desired fresh and clean odor perception.

Now, the present invention provides an effective solution to this objective by realizing a novel fabric rinsing composition which is free of any cationic softener compound.

Other kinds of post-washing products are also known, and provide specific effects to the treated materials. For instance U.S. Pat. No. 4,828,750 describes a fabric rinse composition that removes residual soap and surfactant left in the clothes during washing.

As pointed out above, besides the pleasant feel to the touch or rising effect provided on the treated fabrics, the consumers usually expect from a product such as a fabric softener or a rinse composition that the latter imparts a freshness or a pleasant smell to the treated material. In fact, it turns out that the perfume present in a detergent composition is usually only slightly or even not at all perceived after a washing cycle. Conversely, the post-washing treatment of the linen, since it is carried out under smoother conditions, allows a better deposit of the perfume onto the treated surface, such that the consumers perceive this freshness and/or fragrance longer after its treatment. However, the fabric softeners or rinsing compositions disclosed up to date only allow to incorporate limited quantities of perfuming ingredients and, as a consequence, they deliver limited amounts of perfume during the post-washing treatment.

The present invention provides a solution to this second problem encountered in the prior art with fabric rinsing compositions that, upon use, imply solubilization of high quantities of perfuming ingredients. More particularly, the compositions of the invention consist of oil-in-water emulsions prepared by a process which unexpectedly leads to a product susceptible of depositing large quantities of the perfume incorporated in the emulsions onto the treated surface, thus providing a pleasant fresh smelling effect to the fabric for a prolonged period of time after this treatment.

SUMMARY OF THE INVENTION

The present invention relates to a fabric rinsing composition, free of cationic compound, comprising from 0.1 to 18% by weight of a perfuming ingredient or composition; from 0.1 to 25% by weight of a stabilising oil; from 0.1 to 18% by weight of a non-ionic surfactant system with a hydrophilic lipophilic balance above 10; and from 0.01 to 50% by weight of an acid susceptible of forming water-soluble salts of alkaline-earth compounds; the remainder of the composition being water; all the percentages being given by weight relative to the total weight of the composition, and the composition being in the form of an oil-in-water emulsion obtained by a phase inversion temperature process.

The phase inversion temperature process comprises the steps of preparing a mixture comprising the perfuming ingredient or composition, the stabilising oil and the non ionic surfactant system (oily phase); then preparing a mixture comprising the water and the acid (aqueous phase); adding one phase to the other and stirring to form an emulsion; heating the emulsion to its phase inversion temperature and finally cooling the emulsion to a temperature below its phase inversion temperature.

The use of such a composition in the post-washing treatment of a fabric to obtain an efficient rinsing of the latter, while advantageously delivering high amounts of perfume onto the fabric, as well as a process for delivering high amounts of perfume onto a fabric during a post-washing treatment, are also objects of the present invention.

Therefore, we have unexpectedly succeeded in preparing novel fabric rinsing compositions which, besides being entirely free of cationic softening agent and effectively rinsing the materials treated, present the main asset of delivering high quantities of perfume onto the treated fabric while leaving it with a pleasant and non-fatty touch appreciated by the users of the fabric softener product. The compositions of the invention form a new and advantageous post-wash treating product and they lead to treated linen having a freshness and/or fragrance which will be perceived for an extended period of time.

Within the framework of the invention, what is meant by "rinsing" is, as usually employed in the art, the fact of suppressing alkalinity and limestone residues or yet detergent residues deposited onto the fabrics during the washing. The presence of the acid in the aqueous phase of the compositions of the invention advantageously allows to form salts with the compounds responsible for the water hardness and thus allows to leave a perfectly rinsed and softened fabric or textile.

The compositions of the invention are characterised by the fact that they are in the form of oil-in-water emulsions prepared by a phase inversion temperature (PIT) process. A phase inversion temperature process is a process to form an emulsion, implying the use of a non-ionic surfactant system, which plays on the influence of the "phase inversion temperature" on the solubilization capacity of non-ionic surfactants. This process is well known in the art for preparing emulsions other than that presently disclosed. In particular, it is known that oil-in-water emulsions prepared with non-ionic emulsifiers and stabilized, undergo phase inversion on heating. As a result of the phase inversion process, the outer aqueous phase becomes the inner phase at relatively high temperatures. This process is generally reversible, i.e. the original emulsion type is reformed on cooling. The position of the phase inversion temperature depends on many factors, including for example the type and phase volume of the oil component, the hydrophilicity and structure of the emulsifier or the composition of the emulsifier system (see for example K. Shinoda and H. Kunieda in the Encyclopedia of Emulsion Technology, Volume I, P. Becher (ed.), Marcel Decker, New York 1983, pages 337 and seq.).

Phase inversion temperature (PIT) emulsions have been described to be useful for a number of applications in the skin care and hair care fields, for example for shampoos, hair lotions, foam baths, creams, lotions or emollients. However, to the best of our knowledge, this type of emulsions has never been disclosed as being potentially useful in the home care area and we have found no teaching or suggestion in the prior art that such emulsions could provide advantages over the use of conventional fabric softening compositions or products.

The emulsions of the invention advantageously comprise a limited amount of surfactant, and at the same time a high amount of perfuming ingredients in the oily phase. As a consequence, as mentioned above, in addition to the rinsing effect, the compositions of the invention advantageously provide freshness and/or a pleasant smell to the fabric treated. More particularly the compositions of the invention are responsible for a very efficient deposition of perfume onto the surface treated and make it possible to increase the amount of fragrance in the textile, thus intensifying the odor emanating from the fabrics after their washing and rinsing.

It is for example known that in some countries consumers particularly value clothes and textiles which have a strong fresh, clean and pleasant smell as they come out of the washing and after drying.

In order to obtain such an effect, users resort to adding perfume directly to the rinsing water. Now, the fabric treating compositions of the present invention will be particularly advantageous for use in such countries as they make it possible to obtain this intensifying odor effect without the need to add any free perfume to the rinsing water.

More aspects and advantages of the invention will become apparent from the detailed description and the examples provided herein.

DETAILED DESCRIPTION OF THE PREFERRED EMBODIMENTS

A first embodiment of the invention is a fabric rinsing composition, free of cationic softening compound, in the form of a PIT emulsion.

The proportion of perfuming ingredients within the compositions of the invention, in association with their physical form, provides a good advantage compared with usual fabric softener compositions, as they are, in an unexpected manner, well deposited onto the treated surface during the use of the compositions. The perfuming ingredients which suit the invention are currently used perfuming ingredients, in the form of individual compounds or in the form of mixtures. Their nature does not necessitate a more detailed description here, which would not be exhaustive anyway, the person skilled in the art being capable of choosing them thanks to his or her general knowledge and as a function of the olfactory effect it is desired to achieve. These ingredients belong to varied chemical classes, such as alcohols, aldehydes, ketones, esters, ethers, acetates, nitrites, terpenic hydrocarbons, nitrogen- or sulphur-containing heterocyclic compounds, as well as essential oils of natural or synthetic origin. Most of these ingredients are listed in reference textbooks such as Perfume and Flavour Chemicals from S. Arctander, 1969, Montclair, N.J., USA, or more recent versions thereof, or in other reference textbooks of similar nature, as well as in more recent scientific and patent literature concerning the field of perfumery.

The oil phase of the composition of the invention further comprises from 0.1 to 25% by weight relative to the total weight of the composition of a stabilising oil. In a particular embodiment, the composition comprises from 0.2 to 10% by weight of this oil, and in an even more particular embodiment, it comprises from 0.25 to 5% by weight of the latter. The presence of the oil in the composition advantageously helps in the deposition of perfume onto the treated fabrics. Suitable stabilising oils within the framework of the invention include heavy paraffins such as eicosane at 20 carbon atoms, or yet isoparaffin fractions commercialised under the tradenames Isopar®, for instance Isopar® V, sold by Exxon Chemicals, or yet other paraffin fractions, Gemseal® 60 commercialised by Total.

The surfactant system present in the oil phase is entirely non-ionic and is characterised by a hydrophilic lipophilic balance (HLB) above 10. As non limiting examples of non-ionic surfactants suitable for the present invention, one can cite those belonging to one of the families constituted by the polyethylene glycol stearyl ethers, polyethylene glycol oleylethers, polyethylene glycol nonylphenylethers and polysorbates. Other alkylethers of polyethylene glycol can be used in the present invention. The use of mixtures of surfactants proved to be particularly advantageous. The hydrophilic lipophilic balance (HLB) characterising the surfactant system is above or equal to 10. According to a particular embodiment of the invention, there will be used a surfactant chosen from the family of polyethyleneglycol stearyl ethers. Mixtures of polyoxyethylene 20 stearyl alcohol and polyoxyethylene 20 stearyl 21 alcohol are particularly appreciated.

The aqueous phase of the emulsion consists of a mixture comprising water and from 0.01 to 50% by weight, relative to the total weight of the composition, of an acid susceptible of forming water-soluble salts of alkaline earth compounds, percentages being relative to the total weight of the final composition. The acid suitable for the purpose of the invention is organic or inorganic, preferably an aliphatic monocarboxylic or polycarboxylic acid comprising from 1 to 6 carbon atoms. Non limiting examples of such acids include lactic acid, tartaric acid, adipic acid, citric acid or acetic acid. In a particular embodiment, the quantity of acid present in the emulsion of the invention is comprised between 0.1 to 15% by weight relative to the total weight of the emulsion, and in a more particular embodiment, between 0.5 and 5% by weight. The acid present in the formulation of the invention is capable of forming water-soluble salts of alkaline earth compounds and provides a perfect rinsing of the fabric, and more particularly allows to eliminate the residues left onto the fabric after a washing cycle, thus brightening up the colours of the treated material and also limiting its roughness to the touch.

The phase inversion temperature process used for the preparation of the compositions of the invention comprises the steps of adding the water and the acid to a homogeneous mixture consisting of the surfactant system, the perfuming ingredient or composition and the stabilizing oil; then stirring the mixture to form an emulsion; heating this emulsion to its phase inversion temperature and finally cooling the emulsion to a temperature below its phase inversion temperature.

The phase inversion temperature corresponds to the temperature at which the surfactant system exchanges its preferred solubility from water to oil when the temperature raises and conversely when it decreases. In the transition range (oil/water, water/oil), at temperatures close to the PIT value, the hydrophilic-lipophilic properties of the surfactant system are at optimal equilibrium, thus allowing a maximum solubilization of both oil and water by the surfactant system. The interfacial tension is reduced to a minimum, allowing the appearance of a surfactant phase. It forms a bicontinuous structure: a microemulsion is usually formed spontaneously, without requiring any mechanical energy contribution. The phase inversion temperature value is a parameter which is a function of the proportion of surfactant system, the surfactant system/oil ratio, the oil/water ratio and the HLB value. It can therefore vary in a wide range of values, but a skilled person in the art is capable of experimentally controlling the temperature at which this phase inversion occurs.

The obtained emulsion is an oil-in-water emulsion, optically translucent with a blue-tinged colour. The particle size varies in a range of from 30 to 200 nm.

The obtained emulsion unexpectedly proved to efficiently depose large amounts of perfume onto the treated fabric while providing a good rinsing of the latter. The product thus constitutes a ready-to-use consumer product which is capable of delivering perfume and rinsing a washed fabric. The perfume is well deposited onto the linen and will be perceived for a prolonged period of time.

It goes without saying that the emulsions of the invention can be dispensed in single or multi-dose form. For example, such emulsions can be packaged within water insoluble envelopes, to be added directly to the rinsing water in a single dose.

The invention will now be described in a more detailed manner in the following examples, wherein the temperatures are indicated in degrees Celsius and the abbreviations have the usual meaning in the art.

EXAMPLES

Example 1

Fabric Rinse Composition

A fabric rinse composition according to the invention was prepared from the following formulation:

| Ingredient | Parts by weight |
|---|---|
| Perfuming base* | 0.75 |
| Geamseal ® 60[1)] | 0.37 |
| Brij 78P[2)] | 0.66 |
| Brij 721[3)] | 0.09 |
| Acetic acid | 5.00 |
| Water | 93.13 |
| Total | 100.00 |

[1)]origin: Total, France
[2)]polyoxyethylene 20 stearyl alcohol; origin: Uniquema, The Netherlands
[3)]polyoxyethylene 21 stearyl alcohol; origin: Uniquema, The Netherlands
*the perfuming base was obtained by admixing the following ingredients:

| Ingredient | Parts by weight |
|---|---|
| Benzyl acetate | 5.5 |
| Aldehyde C10 | 0.5 |
| Cetalox ®[1)] | 1.0 |
| Dimethol ®[2)] | 5.0 |
| Lorysia ®[3)] | 30.0 |
| Geraniol | 11.0 |
| Lilial ®[4)] | 15.0 |
| Hedione ®[5)] | 7.0 |
| Phenethylol | 10.0 |
| Hexyl salicylate | 15.0 |
| Total | 100.0 |

[1)]8,12-epoxy-13,14,15,16-tetranorlabdane; origin: Firmenich SA, Geneva, Switzerland
[2)]2,6-dimethyl-2-heptanol; origin: Givaudan-Roure SA, Vernier, Switzerland
[3)]4-(1,1-dimethylethyl)-1-cyclohexyl acetate; origin: Firmenich SA, Geneva, Switzerland
[4)]3-(4-tert-butylphenyl)-2-methylpropanal; origin: Givaudan-Roure SA, Vernier, Switzerland
[5)]methyl dihydrojasmonate; origin: Firmenich SA, Geneva, Switzerland Preparation The surfactant system (Brij 78P and Brij 721) was mixed with the oily phase (perfuming base and Gemseal® 60) at room temperature (about 25°) and heated until a clear mixture was obtained. The aqueous phase containing the water and the acetic acid was then added. The resulting mixture was heated so as to obtain a coarse emulsion, while maintaining smooth stirring (200 rpm). While the temperature was raising, the emulsion became finer and more viscous. The mixture was heated to 88° for 10 min and then cooled down quite rapidly to room temperature (25°) under same stirring.

There was thus obtained an oil-in-water emulsion finely dispersed, optically translucent with blue-tinged light. The particle size was measured by means of a granulometer (Autosizer 4700, origin: Malvern; measure angle: 60°; laser wavelength: 532 nm; measuring temperature: 25°°; monomodal analysis mode in intensity). The particles mean size was of 36.1 nm after formulation.

Example 2

Fabric Rinse Composition

A fabric rinse composition according to the invention was prepared from the following formulation:

| Ingredient | Parts by weight |
|---|---|
| Perfuming base* | 0.75 |
| PureSyn ® 2[1)] | 0.37 |
| Brij 78P[2)] | 0.66 |
| Brij 721[3)] | 0.09 |
| Acetic acid | 5.00 |
| Water | 93.13 |
| Total | 100.00 |

*see Example 1
[1)]isoparaffin; origin: Mobil, USA
[2),3)]see Example 1

The emulsion was prepared as described in Example 1. The product obtained was characterised by a particle size comprised between 36 and 55 nm after 90 days at 37°.

Example 3

Fabric Rinse Composition

A fabric rinse composition according to the invention was prepared from the following formulation:

| Ingredient | Parts by weight |
|---|---|
| Perfuming base* | 0.75 |
| PureSyn ® 2[1)] | 0.37 |
| Brij 78P[2)] | 0.66 |
| Brij 721[3)] | 0.09 |
| Citric acid | 5.00 |
| Water | 93.13 |
| Total | 100.00 |

*see Example 1
[1),2),3)]see Example 1

The emulsion was prepared as described in Example 1. The product obtained was characterised by a particle size comprised between 40 and 48 nm after 90 days at 37°.

Example 4

Fabric Rinse Composition

A fabric rinse composition according to the invention was prepared from the following formulation:

| Ingredient | Parts by weight |
|---|---|
| Perfuming base* | 0.75 |
| PureSyn ® 2[1)] | 0.37 |
| Brij 78P[2)] | 0.66 |
| Brij 721[3)] | 0.09 |
| Phosphoric acid | 5.00 |
| Water | 93.13 |
| Total | 100.00 |

*see Example 1
[1,2,3)]see Example 1

The emulsion was prepared as described in Example 1. The product obtained was characterised by a particle size comprised between 36 and 61 nm after 90 days at 37°.

Example 5

Comparative Example as Regards Perfume Deposition Onto a Treated Fabric Between a Fabric Rinse Composition According to the Invention and a Conventional Fabric Softener A conventional fabric softener was prepared with the following ingredients:

| Ingredients | Parts by weights |
|---|---|
| Stepantex ® vs 90[1)] | 16.50 |
| $CaCl_2$ (10% solution) | 0.20 |
| Perfuming base* | 0.75 |
| Deionised water | 82.55 |
| Total | 100.00 |

*see Example 1
[1)]origin: Stepan, USA

Preparation

Under stirring at 40-50°, Stepantex® was gently added in the water. The mixture was agitated during 10 min until the emulsion was homogeneous and smooth. Calcium chloride was gradually added during the addition of Stepantex® to avoid gel formation. The perfume was added around 35° and agitation was again provided for 5 min.

The formed fabric softener composition was compared with a fabric rinse composition according to the invention as disclosed in Example 2, during a blind triangular test wherein each panellist was given three samples among which 2 were identical and one was different. The panellist had to find out the odd sample.

This triangular test was carried out with 42 panellists. 18 Standard polycotton squares and 2 kg of fabric ballast were washed in a European washing machine with frontal loading. 85 G of unperfumed detergent were used to wash at 40° and 35 ml of the formulation disclosed in Example 2, respectively 35 ml of the conventional softener above, were added to the softener compartment of the machine for the rinsing.

The panellists evaluated the two loads of fabrics thus treated, on a blind test as pointed out here-above.

The results of the evaluation test showed that 18 our of the 42 panellists did find a difference as regards the perfume intensity left by formula according to Example 2 and by the softener on the cotton fabrics after 24 hours and after 3 days.

As regards the freshness, for the panellists who found a difference between the two batches of cotton fabrics, a significant freshness difference was observed at 96% (14 over 18 people) after three days of drying in favour of the cotton fabrics rinsed with formula of Example 2, which were found to be less fatty and fresher that those rinsed with the classical fabric softener.

Example 6

Fabric Rinse Composition

A fabric rinse composition according to the invention was prepared from the following formulation:

| Ingredient | Parts by weight |
|---|---|
| Perfume base* | 10 |
| Gemseal 60[1)] | 4 |
| Brij 78P[2)] | 8.75 |
| Brij 721[3)] | 1.25 |
| Acetic acid | 5 |
| Water | 71 |
| Total | 100 |

[1)]origin: Total, France
[1)2)3)]see example 1
*see Example 1

The emulsion was prepared as described in Example 1. The product obtained was characterized by particle size equal to 45 nm.

What is claimed is:

1. A fabric rinsing composition free of cationic compound, comprising:

from 0.1 to 18% of a perfuming ingredient or composition;

from 0.1 to 25% of a stabilising oil;

from 0.1 to 18% of a non-ionic surfactant system comprising a polyethylene glycol stearyl ether having a hydrophilic lipophilic balance above 10; and from 0.01 to 50% of an acid susceptible of forming water-soluble salts of alkaline-earth compounds;

the remainder of the composition being water; all the percentages being given by weight relative to the total weight of the composition;

the composition being in the form of an oil-in-water nanoemulsion obtained by a phase inversion temperature process.

2. A fabric rinsing composition according to claim 1, wherein the particle size of the nanoemulsion is comprised between 30 and 200 nm.

3. A fabric rinsing composition according to claim 1, wherein the acid is a linear or branched, organic or inorganic acid having from 1 to 6 carbon atoms.

4. A fabric rinsing composition according to claim 3, wherein the acid is selected from the group consisting of formic acid, lactic acid, tartaric acid, citric acid, acetic acid, adipic acid and mixtures thereof.

5. A fabric rinsing composition according to claim 4, wherein the acid consists of acetic acid.

6. A fabric rinsing composition according to claim 1, characterized in that it comprises from 0.1 to 15% by weight, relative to the total weight of the composition, of the acid.

7. A fabric rinsing composition according to claim 1, comprising from 0.5 to 5% by weight, relative to the total weight of the composition, of the acid.

8. A process for preparing a fabric rinsing composition in the form of an oil-in-water emulsion free of cationic compounds comprising:

a) preparing a mixture comprising from 0.1 to 18% of a perfuming ingredient or composition;

from 0.1 to 25% of a stabilizing oil;

from 0.1 to 18% of a non-ionic surfactant system comprising a polyethylene glycol stearyl ether having a hydrophilic lipophilic balance above 10;

b) preparing a mixture comprising from 0.01 to 50% of an acid susceptible of forming water-soluble salts of alkaline-earth compounds;

water c) admixing the mixture obtained in step a) and the mixture obtained in step b) and stirring to form an emulsion d) heating the emulsion to its phase inversion temperature;

e) cooling the emulsion to a temperature below its phase inversion temperature;

all percentages being given by weight relative to the total weight of the fabric rinsing composition.

9. A process according to claim 8, wherein the emulsion is a nanoemulsion.

10. A process according to claim 9, wherein the particle size of the nanoemulsion is comprised between 30 and 200 nm.

11. A process according to claim 8, wherein the acid is a linear or branched, organic or inorganic acid having from 1 to 6 carbon atoms.

12. A process according to claim 11, wherein the acid is selected from the group consisting of formic acid, lactic acid, tartaric acid, citric acid, acetic acid, adipic acid and mixtures thereof.

13. A process according to claim 12, wherein the acid consists of acetic acid.

14. A process according to claim 8, comprising from 0.1 to 15% by weight, relative to the total weight of the composition, of the acid.

15. A process according to claim 14, comprising from 0.5 to 5% by weight, relative to the total weight of the composition, of the acid.

16. A fabric rinsing composition free of cationic compound prepared by the process according to claim 8.

* * * * *